US008096346B2

(12) United States Patent
Hua et al.

(10) Patent No.: US 8,096,346 B2
(45) Date of Patent: Jan. 17, 2012

(54) METHOD FOR CASTING HIGH-POWER WIND TURBINE BASE WITH DUCTILE IRON

(75) Inventors: Yongluo Hua, Jiangsu (CN); Jianhong Wang, Jiangsu (CN); Yufang Chen, Jiangsu (CN); Qiang Wang, Jiangsu (CN); Yuebing Wu, Jiangsu (CN)

(73) Assignee: Jiangsu Jixin Wind Energy Technology Co., Ltd., Yunting Jiangying, Jiangsu (CN)

( * ) Notice: Subject to any disclaimer, the term of this patent is extended or adjusted under 35 U.S.C. 154(b) by 293 days.

(21) Appl. No.: 12/363,779

(22) Filed: Feb. 1, 2009

(65) Prior Publication Data

US 2010/0025005 A1 Feb. 4, 2010

(30) Foreign Application Priority Data

Aug. 4, 2008 (CN) ..... 2008 1 0021362

(51) Int. Cl.

| | |
|---|---|
| ***B22C 1/22*** | (2006.01) |
| ***B22C 9/02*** | (2006.01) |
| ***B22C 9/08*** | (2006.01) |
| ***B22D 27/00*** | (2006.01) |

(52) U.S. Cl. ..... 164/526; 164/55.1; 164/134; 164/349; 164/358

(58) Field of Classification Search ..... 164/526, 164/134, 358, 55.1, 349
See application file for complete search history.

(56) References Cited

U.S. PATENT DOCUMENTS 4,919,188 A * 4/1990 Fessel et al. ..... 164/58.1
5,062,466 A * 11/1991 Kubisch et al. ..... 164/7.1

* cited by examiner

*Primary Examiner* — Kevin P Kerns
(74) *Attorney, Agent, or Firm* — Global IP Services; Tianhua Gu

(57) ABSTRACT

A method of casting a base of high-power wind turbines with low-temperature nodular graphite iron, using furan resin sand as the mold sand and having no risers or chills in the mold. The mold undergoes microseismic compaction and has no chills risers. The parting face of the mold is perpendicular to the ground. The molten iron in the mold is solidified evenly. Therefore, shrinkage holes and disperse shrinkages base are reduced greatly and the dregs and air are discharged easily for the base. The pouring system designed together with a reasonable pouring rate and time make the filtering system useful for blocking dregs.

5 Claims, No Drawings

METHOD FOR CASTING HIGH-POWER WIND TURBINE BASE WITH DUCTILE IRON

CROSS REFERENCE TO RELATED PATENT APPLICATION

This application claims the priority of the Chinese patent application No. CN200810021362.3 filed on Aug. 4, 2008, which application is incorporated herein by reference.

FIELD OF THE INVENTION

The present invention relates to an important part of the wind power technology—the casting technique for the ductile iron base of megawatt wind turbines, especially under non-chill and non-riser conditions.

BACKGROUND OF THE INVENTION

For better understanding the following annotates are used to explain the following technical terms appeared in the specification:

EN-GJS-400-18U-LT or EN-GJS-350-22U-LT, trademarks of spherical graphite iron;

QT400-18AL or QT350-22AL, Chinese engineering standards of spherical graphite iron;

EN DIN12680 Level 2 or Level 3 of the UT tests, Chinese engineering standards of non-destructive ultrasonic testing (EN DIN 12680) second level or third level;

EN DIN 1369 Level 3 of the MT tests, a Chinese engineering standard of non-destructive magnetic particle testing (EN DIN 1369) third level.

Currently the price level of energy resources is high, and the dependence on oil leads to a concerning oil crisis. While this is an important global issue, wind energy as a sustainable and green energy source is being promoted all over the world to be an alternative method for electrical generation. Megawatt wind turbines have become the mainstream product in the wind energy industry, and will be an important source of electricity in the electric grid.

The base of the high-power turbines is a crucial part, not only because its working environment is severe, but it needs to support huge dynamic and static load and needs to have a lifespan of at least 20 years as well. This requires high quality of the casting surface and the firmness of the inner structures, and to lower shrinkage cavity and disperse shrinkage. Currently common sand molding processes do not guarantee the casting quality of the bottom surface of the base. All areas of the base are required to go through non-destructive Ultrasonic Testing (UT) and need to meet the standards of EN DIN12680 Level 2 or Level 3 of the UT tests. The essential areas of the base needs to go through Magnetic Particle Testing (MT) and needs to meet the standards of EN DIN 1369 Level 3. The surface cannot have defects thicker than the thickness of the wall and may not have welding repairs. The roughness of the surface needs to be Ra 50-100.

In addition, to meet high performance requirements, the material of the base is spherical graphite iron castings that work under low-temperature conditions. Common trademarks are EN-GJS-400-18U-LT or EN-GJS-350-22U-LT, and structurally the base castings are big complex parts, whose outer radius is 4-5 m, wall thickness 60-200 mm and weight 10-25 ton. The structure of the base is a big flat-bottom part with thick walls, used to support the gear case, contour and other parts. Spherical graphite iron has better performance than other materials, but it is harder to control in the casting process and is more likely to have shrinkage cavity, disperse shrinkage, and oxidation dregs. These problems are more pronounced for big, complex ductile iron with large cross-section areas, and are unlikely to meet the standards of EN DIN12680 Level 2 or Level 3 of the UT tests and EN DIN 1369 Level 3 of the MT tests. Particularly, since the bottom surface of the base has a large area, common sand molding procedure does not ensure good casting quality of the bottom surface. In order to lessen and eliminate disperse shrinkage, the common treatment was to put chills in the hot spots on the base. This method is helpful, but the chills are apt to react with the iron liquid, which produces oxidation dregs and air holes, making the magnetic particles ineffective for detecting defects. The usage of the chills further complicates the sand molding procedure, which lowers the efficiency of the technique. CN200710144925.3 proposes a fast compelling cooling system that is suitable for producing thick and big cross-section castings. This system targets on solving the problem of low dynamic performance of the thick and big cross-section ductile iron, which due to the distortion and floatation of the spherical graphite cast iron, and disperse shrinkage, cavity, and other defects as a result of the long-time crystallization of the liquid iron. The solution is as follows: the outlet of the liquid nitrogen tank is connected to one end of the low-temperature close valve, the other end connected to the inlet of the liquid nitrogen tank. One side of the liquid nitrogen cooler is implemented in the cavity of the cooling core tube, and the other side of the liquid nitrogen cooler is connected to a nozzle. The said method is very costly.

In order to reduce and eliminate disperse shrinkage and meet the standards of EN DIN12680 Level 2 or Level 3, another method that is commonly used is to place many insulating and exothermic risers at the highest place in the sand mold to make up for the shrinks. However, using insulating and exothermic risers lowers the production rate of the technique, and increases the cost of production, which lowers the overall profit of the casting factories.

The base is made by ductile iron, the production of which is prone to first and second oxidation dregs. To decrease the dregs on the surface, the oversea approach is to use high quality furnace charge and electric furnace refining. However, in China raw materials like pig iron have lower quality than the oversea standards, and the smelt technology is also behind, therefore the dregs on the surfaces are hard to get rid of, and the products are unlikely to meet the standards of EN DIN 1690 Level 3 of the MT tests.

CN200510022689.9 −40° C. Low Temperature As-Cast of Ni-Free Ductile Iron for Casting the Base of Megawatt Wind Power Unit is another patent from this applicant. The ingredients are C 3.6-3.9%, Si 1.7-2.5%, Mn 0.1-0.3%, no Ni, Mg residue 0.045-0.07%. The remainder is iron and impurities, among which P<0.04%, and S<0.02%. The low temperature as-cast of Ni-free ductile iron is obtained by adding nodularizer and nucleating agent and post inoculation. The casting technique after nodularization is as follows: at 1300-1380° C. the liquid mixture is poured into the casting mold and it is slowly cooled down in the mold to below 400° C., then taken out of the mold. This method does not guarantee the high qualification rate of the product.

SUMMARY OF THE INVENTION

The objective of this present invention is to propose a technique of non-chill, non-riser ductile iron casting for the base of high-power (megawatt) wind turbines, so that shrinkage is lessened and eliminated, in order to meet the standards of EN DIN 1690 Level 3 of the MT tests.

The technical scheme of this present invention is the casting technique of the low-temperature ductile iron base for megawatt wind turbines. The material is spherical graphite cast iron that bears low-temperature conditions. The trademarks of the material are EN-GJS-400-18U-LT or EN-GJS-350-22U-LT.

Using furan resin sand as the molding sand, the mold is built without risers and undergoes microseismic compaction afterwards. This way, the sand mold has a much higher strength and compaction degree than the ones without microseismic compaction. The parting face of the sand mold is perpendicular to the ground, which makes the manufacturability of the base conform to specific technical requirements.

Another improvement of this present invention is to establish reasonable pouring rate and time, so that the pouring system is optimized to reduce slag accumulation. This way, the molten iron is smoothly poured into the molding cavity and its shrinkage-filling capacity is enhanced.

The pouring rate is controlled to be within 0.3-0.8 m/s, so that the molten iron fills the mold smoothly. The total pouring quantity is between 20-60 kg/s, and the pouring time is 160-600 s.

The molten iron is filtered using a wire mesh.

Other improvements of this present invention include: while casting and after casting, the sand mold is pressed by a heavy weight so that the mold is not raised when the iron is expanded during graphitization and the disperse shrinkage is reduced. The weight weighs about two to six times the weight of the pouring quantity.

The material of the base is spherical graphite iron castings that work under low-temperature conditions. Common trademarks are EN-GJS-400-18U-LT or EN-GJS-350-22U-LT, corresponding to national standards QT400-18AL and QT350-22AL, respectively. An alternative material is the low temperature as-cast of Ni-free ductile iron described in patent CN200510022689.9.

The theory for this technique is as follows: during the solidification of the cast, due to the liquid contraction and the solidification shrinkage of the alloy, it is more likely that there are shrinkage holes and disperse shrinkage in the part that last solidifies in the cast. Since graphite iron cast solidifies in a "mushy" manner, it is difficult for the molten iron to timely fill in, therefore this type of material is more prone to shrinkage holes and disperse shrinkage. However, the graphite cast iron precipitates graphite during solidification, which results in expansion due to graphitization, which makes up for solidification shrinkage. The basic principle of this present invention is to establish parameters in the technique and detailed methods, so that the expansion due to graphitization sufficiently cancels out the effect of liquid contraction and solidification shrinkage, hence eliminating shrinkage holes and disperse shrinkage.

Since the spherical graphite cast iron needs to be modularized, there is a large amount of first oxidation dregs in the molten iron. While being poured into the mold, the molten iron is prone to reacting with air, the mold, and the chill to produce second oxidation dregs. This present technique aims at establishing parameters in the technique and detailed methods. The first oxidation dregs are separated from the molten iron using the pouring system and the filtering system, and the chemical reaction between the molten iron, air and the mold is decreased, hence reducing the second oxidation dregs.

The base in this present invention is a large, complicated part, whose outer radius is 4-5 m, wall thickness 60-200 mm and weight 10-25 ton. The bases used in wind turbines whose power is bigger than 5 MW are larger and heavier. The technique in this present invention satisfies the quality requirements.

The benefits of this present invention is as follows: different from traditional techniques, non-chill, non-riser technique sets parting face of the sand mold perpendicular to the ground, so that the molten iron solidifies evenly, which greatly reduces the shrinkage holes and disperse shrinkage, and the dregs and air are easy to be discharged. The pouring system designed for the base, together with reasonable pouring rate and time, makes the system useful in blocking the dregs. The molten iron is smoothly poured into the mold, its shrinkage-filling capacity is enhanced. The filtering system enhances the purity of the molten iron. The weight restrains the expansion of the material during graphitization, so that the shrinkage is reduced. All areas of the base need to meet the standards of EN DIN12680 Level 2 or Level 3 of the UT tests. The essential areas of the base needs to meet the standards of EN DIN 1369 Level 3 of the MT tests. The surface cannot have defects that go beyond the thickness of the wall and may not have welding repairs. The roughness of the surface needs to be Ra 50-100. This present invention makes the manufacturability of the base conform to specific technical requirements.

DETAIL DESCRIPTION OF THE INVENTION

The details of the technique of non-chill, non-riser ductile iron casting are as follows: the material is made with standard ingredients, then is post inoculated by adding nodularizer and nucleating agent. After nodularization, at 1300-1380° C. the liquid mixture is poured into the casting mold and it is slowly cooled down in the mold to below 400° C., then taken out of the mold.

1) The mold is made with furan resin sand. Compared with other molds, this mold has a smooth surface and accurate dimensions. The high strength of the mold is conducive for the self-filling of the molten iron, so that shrinkage holes and disperse shrinkage are reduced. This method also decreases the chance for chemical reactions in the mold and the molten iron, which reduces oxidation dregs. Therefore, non-riser, non-chill casting technique requires the use of furan resin sand.
2) The bases of high-power (commonly between 1.5 to 5 MW) wind turbines are large casting parts. The exterior and the core sand usually consumes 10-30 ton of sand. Using a 20 T/h or 40 T/h sandmixer, and applying the non-chill, non-riser ductile iron casting technique (preferably using special mixing apparatus for the technique), the sand filling time is controlled to be within 30 minutes. The sand mold undergoes microseismic compaction in large microseismic monitoring system (microseismic compaction lasts a few minutes to twenty minutes and is carried out during molding). This increases the strength of the mold to meet technical requirements.
3) Parting plan designed for the base ensures that the molten iron solidifies evenly. Different from traditional techniques, the parting face of the sand mold in this technique is perpendicular to the ground (along the length or the width of the base), which makes the bearing face of the base perpendicular to the connecting face with the tower structure. Therefore, shrinkage and cavity are reduced on the surface, and the dregs and air are easy to be discharged.
4) Using stepped pipe in the vertical pouring path, the molten iron rapidly fills up the mold cavity. The size of vertical pouring path varies or the path is bent so that the turbulent flow of the molten iron is reduced. The pouring rate is controlled to be between 0.3-0.8 m/s, so that the molten iron is filled smoothly into the mold. The pouring quantity is between 20-60 kg/s (in the actual practice, there is no significant difference whether the pouring quantity is 25, 40 or 60 kg/s), which reduces the temperature difference between parts, and lessens the liquid contraction of the molten iron.

5) The filtering system and the wire mesh are especially designed for the technique, which are capable of filtering over 10 ton of iron. The pouring time is between 200 to 600 s. The mesh is made from inorganic material and is hard to break, so that the impurities in the molten iron can be filtered out adequately.

6) A weight is used so that the mold is not raised when the iron is expanded during graphitization and the disperse shrinkage is reduced. The weight weighs about three to six times the weight of the pouring quantity.

Examples of bases made using the technique of non-chill, non-riser ductile iron casting for the base of high-power wind turbines include 1.5 MW base for GE, Goldwind Science and Technology, and Beijing Heavy-duty Machine. The bases produced were able to meet the standards of EN DIN12680 Level 2 of the UT tests and EN DIN 1369 Level 3 of the MT tests.

What is claimed is:

1. A method for casting a high-power wind turbine base comprising:

using a furan resin sand mold without shrinkage holes and chill casting technique for casting, a casting mold is made by furan resin sand, has stepped pipe vertical and bent pouring paths to reduce turbulent flow of molten iron, a parting face of the mold is perpendicular to a ground along a length of the wind turbine base, the casting mold also has a filtering system for flow of molten iron;

making the casting mold, using the furan resin sand as molding sand to make the casting mold, a furan resin sand filling time is controlled to be within 30 minutes, an allowed using time for the furan resin sand is controlled within 30-40 minutes, then the casting mold undergoes microseismic compaction, the parting face of the sand mold is perpendicular to the ground;

spherical graphite cast iron that bears low-temperature conditions is used for the turbine base;

the spherical graphite cast iron is made with standard ingredients, then is post inoculated by adding nodularizer and nucleating agent, after nodularization, at 1300-1380° C. the liquid mixture is poured into the casting mold, a pouring rate is controlled to be between 0.3-0.8 m/s, a pouring quantity is between 20-60 kg/s;

during the pouring a filtering system is used for the flow of molten iron to enhance the purity of the molten iron;

weight is used for preventing the casting mold to be raised when the iron is expanded during graphitization and reducing disperse shrinkage;

thereafter, a casted turbine base is slowly cooled down in the mold to below 400° C., then take out the casted turbine base out of the mold.

2. The method of claim 1, wherein the turbine base is a big complex part, whose outer radius is 4-5 m, wall thickness 60-200 mm and weight 10-25 ton, a structure of the base is a big flat-bottom part with thick walls, used to support gear cases.

3. The method of claim 1, wherein the filtering system is a wire mesh especially designed for filtering over 10 ton of iron and pouring time between 200 to 600 s, or the mesh is made from inorganic material and is hard to break, so that the impurities in the molten iron can be filtered out adequately.

4. The method of claim 1, wherein the weight for pressing the mold is two to six times of a weight of pouring quantity.

5. The method of claim 1, wherein the spherical graphite cast iron is graphite ductile iron.

* * * * *